US005261027A

United States Patent [19]

Taniguchi et al.

[11] Patent Number: 5,261,027

[45] Date of Patent: Nov. 9, 1993

[54] CODE EXCITED LINEAR PREDICTION SPEECH CODING SYSTEM

[75] Inventors: Tomohiko Taniguchi, Yokohama; Yoshinori Tanaka, Kawasaki; Yasuji Ohta, Yokohama; Fumio Amano, Tokyo; Shigeyuki Unagami, Atsugi; Akira Sasama, Fuji, all of Japan

[73] Assignee: Fujitsu Limited, Kawasaki, Japan

[21] Appl. No.: 997,667

[22] Filed: Dec. 28, 1992

Related U.S. Application Data

[63] Continuation of Ser. No. 545,197, Jun. 28, 1990, abandoned.

[30] Foreign Application Priority Data

Jun. 28, 1989 [JP] Japan ..... 1-166180
Jun. 30, 1989 [JP] Japan ..... 1-168645
Jul. 27, 1989 [JP] Japan ..... 1-195302

[51] Int. Cl.[5] ..... G10L 9/00

[52] U.S. Cl. ..... 395/2

[58] Field of Search ..... 381/29-40, 381/46-47, 51; 395/2

[56] References Cited

U.S. PATENT DOCUMENTS

| | | | |
|---|---|---|---|
| 3,631,520 | 12/1971 | Atal | 364/513.5 |
| 4,133,976 | 1/1979 | Atal et al. | 381/47 |
| 4,220,819 | 9/1980 | Atal | 381/38 |
| 4,472,832 | 8/1984 | Atal et al. | 364/513.5 |
| 4,817,157 | 3/1989 | Gerson | 381/40 |
| 4,860,355 | 8/1989 | Copperi | 381/36 |
| 4,868,867 | 9/1989 | Davidson et al. | 381/35 |
| 4,991,214 | 2/1991 | Freeman et al. | 381/38 |
| 5,001,758 | 3/1991 | Galand et al. | 381/40 |

OTHER PUBLICATIONS

Schroeder, M. R. and Atal, B. S. "Code-Excited Linear Prediction (CELP): High-Auality Speech at Very Low Bit Rates" pp. 937-940 Proceedings of ICASSP'85, 1985.

Davidson, G. and Gersho, A. "Complexity Reduction Methods for Vector Excitation Coding" pp. 3055-3058 Proceedings of ICASSP '86, 1986.

Signal Processing IV: Theories and Applications, Proceedings of EUSIPCO '88, Fourth European Signal Processing Conference, Grenoble, 5th-8th Sep. 1988, vol. II, pp. 859-862, North-Holland, Amsterdam, NL; D. Lin: *Vector Excitation Coding Using a Composite Source Model.*

ICASSP '89, 1989 International Conference on Acoustics, Speech, and Signal Processing, Glasgow, 23rd-26th May 1989, vol. 1, pp. 53-56, IEEE, New York, U.S.; A. Bergstrom et al.: *Code-book Driven Glottal Pulse Analysis.*

ICASSP '88, 1988 International Conference on Acoustics, Speech, and Signal Processing, New York, New York City, 11th-14th Apr. 1988, pp. 151-154, IEEE, New York, U.S.; P. Kroon et al.: *Strategies for Improving the Performance of CELP Coders at Low Bit Rates*, p. 153.

ICASSP'86, IEEE-IECEJ-ASJ International Conference on Acoustics, Speech, and Signal Processing, Tokyo, 7th-11th Apr. 1986, vol. 1, pp. 461-464, IEEE, New York, U.S.; D. Lin: *A Novel LPC Synthesis Model Using a Binary Pulse Source Excitation.*

IEEE Transactions on Acoustics, Speech, and Signal Processing, vol. ASSP-32, No. 4, Aug. 1984, pp. 851-858, IEEE, New York, U.S.; S. Y. Kwon et al.: *An Enhanced LPC Vocoder With No Voiced/Unvoiced Unvoiced Switch.*

*Primary Examiner*—Michael R. Fleming
*Assistant Examiner*—Michelle Doerrler
*Attorney, Agent, or Firm*—Staas & Halsey

[57] ABSTRACT

A code excited linear prediction (CELP) type speech signal coding system is provided, a code vector obtained by applying linear prediction to a vector of a residual speech signal of white noise is stored in a code book. A pitch prediction vector obtained by applying linear prediction to a residual signal of a preceding frame is given a delay corresponding to a pitch frequency and added to the code vector. Use is made of an impulse vector obtained by applying linear prediction to a residual signal vector of impulses having a predetermined relationship with the vectors of the white noise code book. Variable gains are given to at least the above code vector and impulse vector, a reproduced signal is produced, and this reproduced signal is used for identification of the input speech signal. Thus, a pulse series corresponding to the sound source of voiced speech sounds is created.

36 Claims, 14 Drawing Sheets

INDEX i
91
10
CODE BOOK
TABLE
90
(A)
PULSE POSITION
92
IMPULSE SEPARATING CIRCUIT
(B)
WHITE NOISE SIGNAL
IMPULSE
(C)
11
61
62

FIG. 9(A)
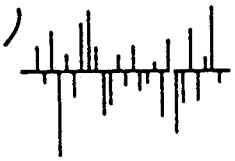
MAXIMUM AMPLITUDE POINT
FIG. 9(B)
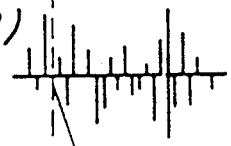
$r_0$
FIG. 9(C)
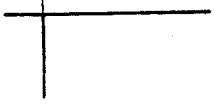
FIG. 14(A)
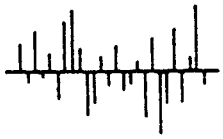
MAXIMUM AMPLITUDE POINT
FIG. 14(B)
Fig.17
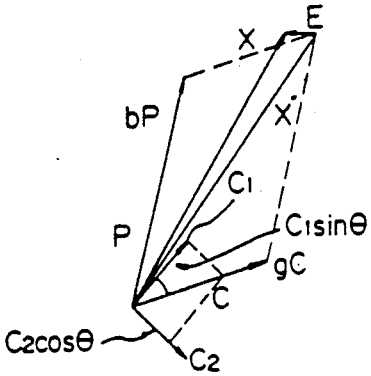

CODE EXCITED LINEAR PREDICTION SPEECH CODING SYSTEM

This application is a continuation of application Ser. No. 07/545,197, filed Jun. 28, 1990, now abandoned.

BACKGROUND OF THE INVENTION

1. Field of the Invention

The present invention relates to a system for speech coding and an apparatus for the same, more particularly relates to a system for high quality speech coding and an apparatus for the same using vector quantization for data compression of speech signals.

2. Description of the Related Art

In recent years, use has been made of vector quantization for maintaining the quality and compressing the data of speech signals in intra company communication systems, digital mobile radio systems, etc. The vector quantization system is a well known one in which predictive filtering is applied to the signal vectors of a code book to prepare reproduced signals and the error powers between the reproduced signals and an input speech signal are evaluated to determine the index of the signal vector with the smallest error. There is rising demand, however, for a more advanced method of vector quantization so as to further compress the speech data.

FIG. 1 shows an example of a system for high quality speech coding using vector quantization. This system is known as the code excited LPC (CELP) system. In this, a code book 10 is preset with $2^m$ patterns of residual signal vectors produced using N samples of white noise signal which corresponds to an N dimensional vector (in this case, shape vectors showing the phase, hereinafter referred to simply as vectors). The vectors are normalized so that the power of N samples (N being, for example 40) becomes a fixed value.

Vectors read out from the code book 10 by the command of the evaluating circuit 16 are given a gain by a multiplier unit 11, then converted to reproduced signals through two adaptive prediction units, i.e., a pitch prediction unit 12 which eliminates the long term correlation of the speech signals and a linear prediction unit 13 which eliminates the short term correlation of the same.

The reproduced signals are compared with digital speech signals of the N samples input from a terminal 15 in a subtractor 14 and the errors are evaluated by the evaluating circuit 16.

The evaluating circuit 16 selects the vector of the code book 10 giving the smallest power of the error and determines the gain of the multiplier unit 11 and a pitch prediction coefficient of the pitch prediction unit 12.

Further, as shown in FIG. 2, the linear prediction unit 13 uses the linear prediction coefficient found from the current frame sample values by a linear prediction analysis unit 18 in a linear difference equation as filter tap coefficients. The pitch prediction unit 12 uses the pitch prediction coefficient and pitch frequency of the input speech signal found by a pitch prediction analysis unit 31 through a reverse linear prediction filter 30 as filter parameters.

The index of the optimum vector in the code book 10, the gain of the multiplier unit 11, and the parameters for constituting the prediction units (pitch frequency, pitch prediction coefficient, and linear prediction coefficient) are multiplexed by a multiplexer circuit 17 and become coded information.

The pitch period of the pitch prediction unit 12, is, for example, 40 to 167 samples, and each of the possible pitch periods is evaluated and the optimum period is chosen. Further, the transmission function of the linear prediction unit 13 is determined by linear predictive coding (LPC) analysis of the input speech signal. Finally, the evaluating circuit 16 searches through the code book 10 and determines the index giving the smallest error power between the input speech signal and residual signal. The index of the code book 10 which is determined, that is, the phase of the residual vector, the gain of the multiplier unit 11, that is, the amplitude of the residual vector, the frequency and coefficient of the pitch prediction unit 12, and the coefficients of the linear prediction unit 13 are transmitted multiplexed by the multiplexer circuit 17.

On the decoder side, a vector is read out from a code book 20 having the same construction as the code book 10, in accordance with the index, gain, and prediction unit parameters obtained by demultiplexing by the demultiplexer circuit 19 and is given a gain by a multiplier unit 21, then a reproduced speech signal is obtained by prediction by the prediction units 22 and 23.

In such a code excited linear prediction (CELP) system, as the means for producing the speech signal, use is made of the code book 10 comprised of white noise and the pitch prediction unit 12 for giving periodicity at the pitch frequencies, but the decision on the phase of the code book 10, the gain (amplitude) of the multiplier unit 11, and the pitch frequency (phase) and pitch prediction coefficient (amplitude) of the prediction unit 12 is made equivalently as shown in FIG. 3.

That is, the processing for reproducing the vector of the code book 10 by the pitch prediction unit and linear prediction units for identification of the input signal, considered in terms of the vectors, may be considered processing for the identification, by subtraction and evaluation by a subtractor 50, of a target vector X obtained by removing from the input signal S of one frame input from a terminal 40, by a subtractor 41, the effects of the previous frame $S_0$ stored in a previous frame storage 42, with a vector X′ obtained by adding by an adder 49 a code vector gC obtained by applying linear prediction to a vector selected from a code book 10 by a linear prediction unit 44 (corresponding to the linear prediction unit 13 of FIG. 1) and giving a gain g to the resultant vector C by a multiplier unit 45 and a pitch prediction vector bP obtained by applying linear prediction by a linear prediction unit 47 to a residual signal of the previous frame given a delay corresponding to a pitch frequency from a pitch frequency delay unit 46 (corresponding to the pitch frequency analyzed by the pitch prediction analysis unit 31 of FIG. 1) and giving a gain b (corresponding to the pitch prediction coefficient analyzed by the pitch prediction unit 31 of FIG. 1) to the resultant vector P.

When the phase C of the code vector and the phase P of the pitch prediction vector are given, the amplitude g of the code vector and the amplitude b of the pitch prediction vector which, as shown in FIG. 4, satisfy the condition that the value of the error power $|E|^2$ partially differentiated by b and g by the following equation (1) is 0 so as to give the minimum error signal power, that is, satisfy $$\partial|E|^2/\partial b=0, \partial|E|^2/\partial g=0$$

may be found from the following equations (2) and (3) for all combinations of the phases (C,P) of the two vectors and thereby the set of the most optimal amplitudes and phases (g, b, C, P) sought:

$$|E|^2=|X-bP-gC|^2 \quad (1)$$

$$b=((C,C)(X,P)-(C,P)(X,C))/\Delta \quad (2)$$

$$g=((P,P)(X,C)-(C,P)(X,P))/\Delta \quad (3)$$

where $\Delta=(P,P)(C,C)-(C,P)(C,P))$ and (,) indicates the scalar product of the vector.

Here, speech signals include voiced speech sounds and unvoiced speech sounds which are characterized in that the respective drive source signals (sound sources) are periodic pulses or white noise with no periodicity.

In the CELP system, explained above as a conventional system, pitch prediction and linear prediction were applied to the vectors of the code book comprised of white noise as a sound source and the pitch periodicity of the voiced speech sounds was created by the pitch prediction unit 12.

Therefore, while the characteristics were good when the sound source signal was a white noise-like unvoiced speech sound, the pitch periodicity generated by the pitch prediction unit was created by giving a delay to the past sound source series by pitch prediction analysis, and the past sound source series was series of white noise originally obtained by reading code vectors from a code book, therefore, it was difficult to create a pulse series corresponding to the sound source of a voiced speech sound. This was a problem in that in the transitional state from an unvoiced speech sound to a voiced speech sound, the effect of this was large and high frequency noise was included in the reproduced speech, resulting in a deterioration of the quality.

SUMMARY OF THE INVENTION

Therefore, the present invention has as its object, in a CELP type speech coding system and apparatus wherein a gain is given to a code vector obtained by applying linear prediction to white noise of a code book and a pitch prediction vector obtained by applying linear prediction to a residual signal of a preceding frame given a delay corresponding to the pitch frequency, a reproduced signal is generated from the same, and the reproduced signal is used to identify the input speech signal, the creation of a pulse series corresponding to the sound source of a voiced speech sound and the accurate identification and coding for even a pulse-like sound source of a voiced speech sound so as to improve the quality of the reproduced speech.

To achieve the above object, there is provided, according to one technical aspect of the present invention, a system for speech coding of the CELP type wherein a reproduced signal is generated from a code vector obtained by applying linear prediction to a vector of a residual signal of white noise of a code book and a pitch prediction vector obtained by applying linear prediction to a residual signal of a preceding frame given a delay corresponding to a pitch frequency, the error between the reproduced signal and an input speech signal is evaluated, the vector giving the smallest error is sought, and the input speech signal is encoded accordingly, the system for speech coding characterized in that in addition to the code vector and pitch prediction vector, use is made of a residual signal vector of an impulse having a predetermined relationship with the vectors of the white noise code book, variable gains are given to at least the code vector and an impulse vector obtained by applying linear prediction to the vector of the residual signal of the impulse, then the vectors are added to form a reproduced signal and the reproduced signal is used to identify the input speech signal.

Further, there is provided, according to another technical aspect of the present invention, an apparatus for speech coding characterized by being provided with a pitch frequency delay circuit giving a delay corresponding to a pitch frequency to a vector of a preceding residual signal, a first code book storing a plurality of vectors of residual signals of white noise, an impulse generating circuit generating an impulse having a predetermined relationship with the vectors of the residual signals of the white noise stored in the first code book, linear prediction circuits connected to the pitch frequency delay circuit, the first code book, and the impulse generating circuit, a variable gain circuit for giving a variable gain to vectors output from the linear prediction circuits connected to at least the first code book and the impulse generating circuit, a first addition circuit for adding the outputs of the variable gain circuit and producing a reproduced composite vector, an input speech signal input unit, a second addition circuit for adding the reproduced composite vector and the vector of the input speech signal, and an evaluating circuit for evaluating the output of the second addition circuit and identifying the input speech signal from the vector of the reproduced signal.

BRIEF DESCRIPTION OF THE DRAWINGS

FIGS. 9(A) through 9(C) are views showing signals at various portions of FIG. 8;

FIGS. 14(A) and 14(B) are views showing signals at various portions in FIG. 13;

FIG. 17 is a view showing the method of analysis the other embodiment of the present invention shown in FIG. 13.

DESCRIPTION OF THE PREFERRED EMBODIMENTS

Figure 1:
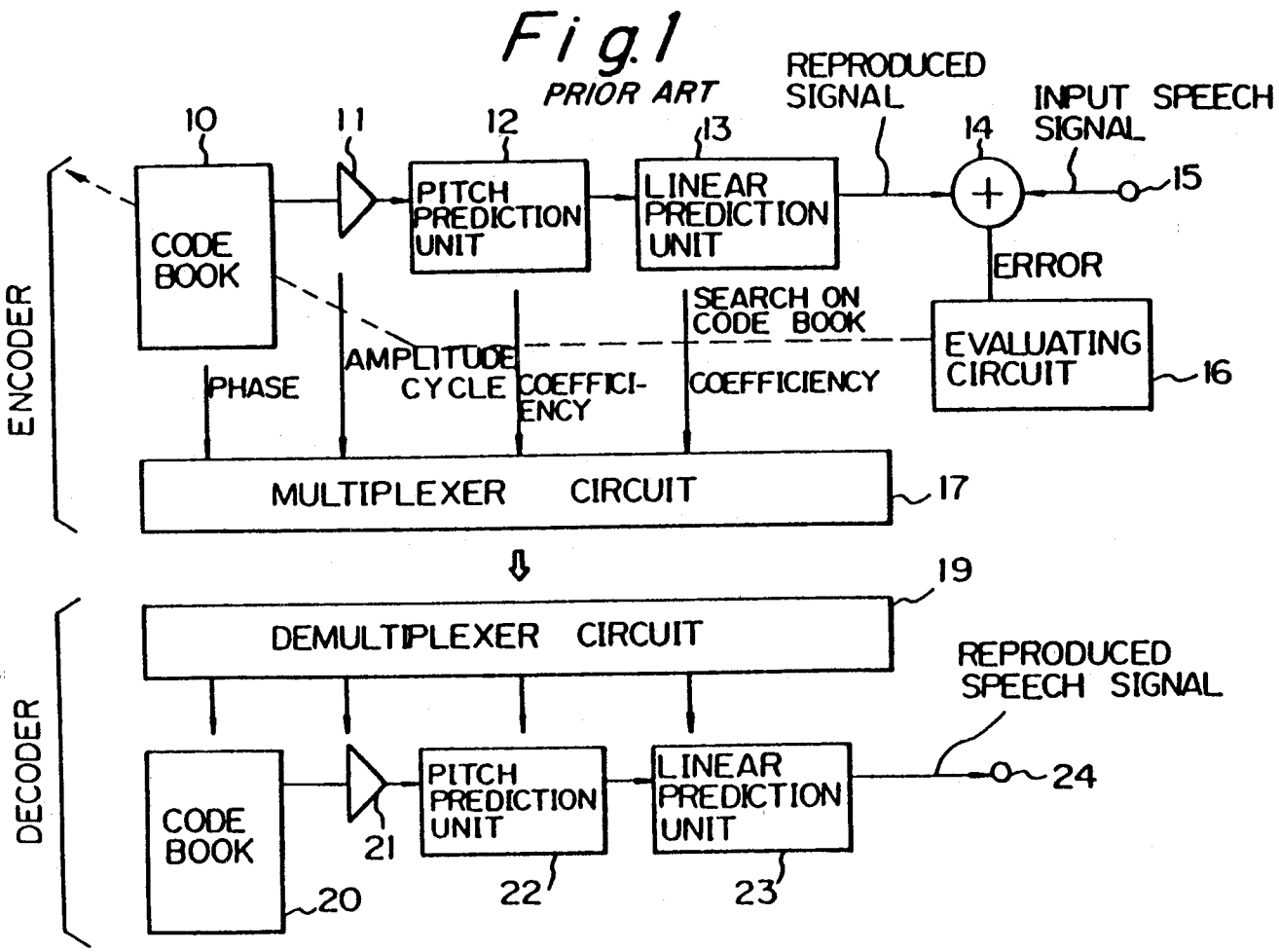
Fig. 1 PRIOR ART
FIGS. 1 and 2 are block diagrams for explaining an example of a speech coding system of the related art.

Embodiments of the speech coding system and the speech coding apparatus of the present invention will be explained in detail below while referring to the appended drawings.

The basic constitution of the speech coding system of the present invention, as mentioned above, is that of a conventionally known CELP type speech coding system wherein in addition to the code vector and pitch prediction vector, use is made of a residual signal vector of an impulse having a predetermined relationship with the vectors of the white noise code book, variable gains are given to at least the code vector and an impulse vector obtained by applying linear prediction to the vector of the residual signal of the impulse, then the vectors are added to form a reproduced signal and the reproduced signal is used to identify the input speech signal.

That is, the present invention is constituted by a conventionally known system wherein a synchronous pulse serving as a sound source for voiced speech sounds is introduced and a pulse-like sound source of voiced speech sounds is created by the use of a residual signal vector of an impulse having a predetermined relationship with the vectors of the white noise code book. By this, in the present invention, the vector of the residual signal of the white noise and the vector of the residual signal of the impulse are added while varying the amplitude components of the two vectors so as to reproduce a composite vector, so it is possible to accurately identify and code not only the white noise-like sound source of unvoiced speech sounds, but also the periodic pulse series sound source of voiced speech sounds and thereby to improve the quality of the reproduced signal.

The residual signal vector of the impulse used in the present invention may be an impulse vector having a predetermined relationship with the residual vectors of white noise stored in the first code book 10, specifically, may be one corresponding to one residual vector of white noise stored in the first code book. Further, the one impulse vector may be one corresponding to one of the predetermined sample positions, i.e., predetermined pulse positions, of a white noise residual vector in the first code book. More specifically, as mentioned later, the impulse vector may be one corresponding to a main element pulse position in the white noise residual vector or, as a simpler method, the impulse vector may be one corresponding to the maximum amplitude pulse position of the white noise residual vector. The impulse residual vector used in the present invention may be one formed by separation from a white noise residual vector stored in the first code book. Further, for that purpose, use may be made of a second code book for storing command information for separating this from the white noise residual vector stored in the first code book. Also, the second code book may store preformed impulse vectors.

Therefore, the second code book preferably is of the same size as the first code book.

Figure 5:
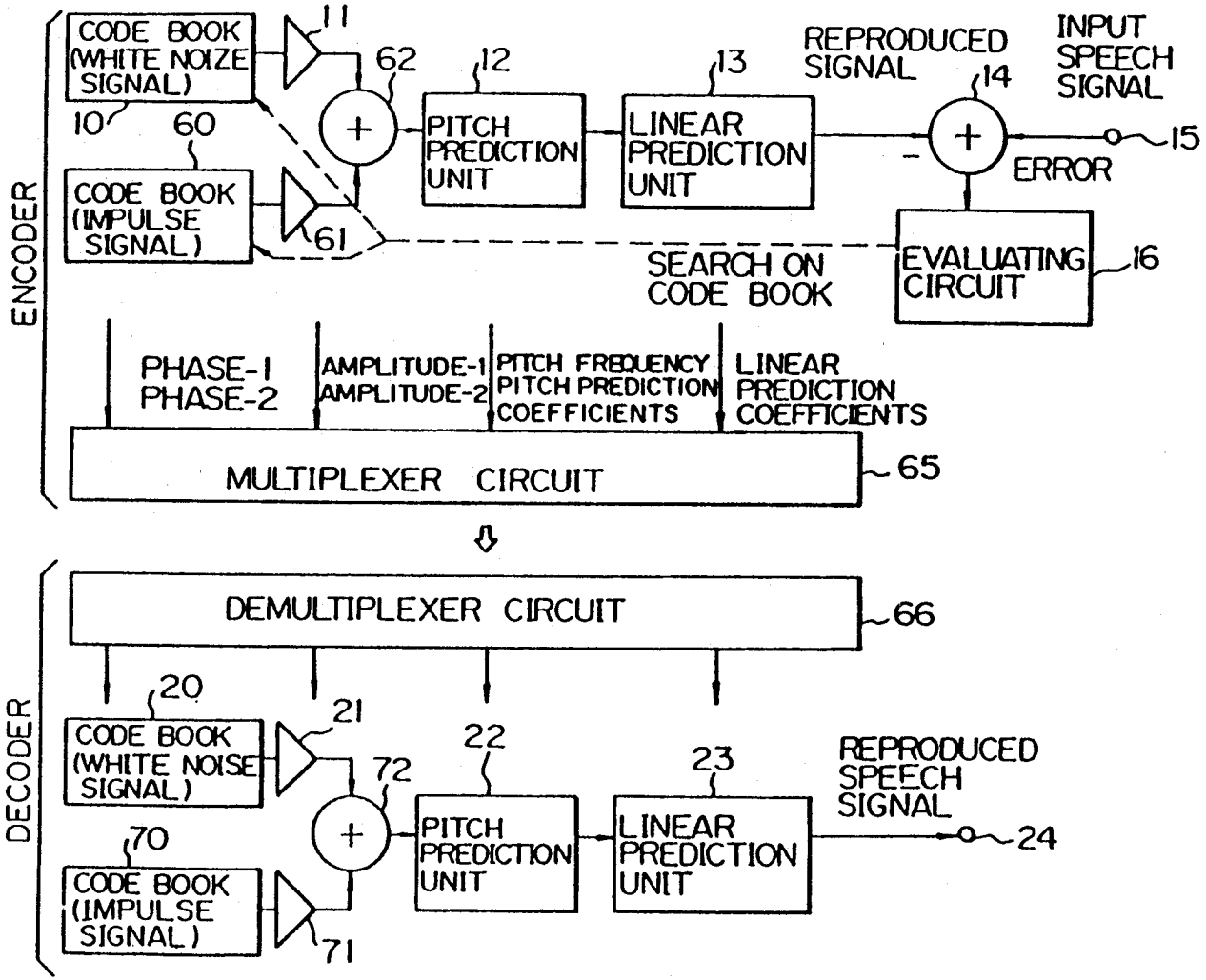
FIG. 5 is a block diagram of an embodiment of the system of the present invention.

FIG. 5 is a block diagram of an embodiment of a speech coding system of the present invention. In the figure, portions the same as in FIG. 1 are given the same reference numerals and explanations of the same are omitted.

FIG. 5 shows the constitution of the transmission side. In the code book 10 are stored $2^m$ patterns of N dimensional vectors of residual signals formed by white noise, as in the past. In the code book 60 are stored N patterns of N dimensional vectors of residual signals of impulses shifted successively in phase.

The impulse vectors from the code book 60 are supplied through a multiplier unit 61 to an adder 62 where they are added with vectors of white noise supplied from the code book 10 through an adder 11 and the result is supplied to a pitch prediction unit 12. An evaluating circuit 16 searches through the code books 10 and 60 and determines the vector giving the smallest error signal power between the input speech signal and the reproduced signal from the linear prediction unit 13. The index of the code book 10 decided on, that is, the phase-1 of the residual vector of the white noise, the index of the code book 60, that is, the phase-2 of the residual vector of the impulse, and the gains of the multiplier units 11 and 61, i.e., the amplitude-1 and amplitude-2 of the residual vectors, the frequency and coefficient of the pitch prediction unit 12 as in the past, and the coefficient of the linear prediction unit 13 are transmitted multiplexed by a multiplexer circuit 65.

On the receiving side, the transmitted multiplexed signal is demultiplexed by the demultiplexer circuit 66. Code books 20 and 70 have the same constitutions as the code books 10 and 60. From the code books 20 and 70 are read out the vectors indicated by the indexes (phase-1 and phase-2). These are passed through the multiplier units 21 and 71, then added by the adder 72 and reproduced by the pitch prediction unit 22 and further the linear prediction unit 23.

Figure 2:
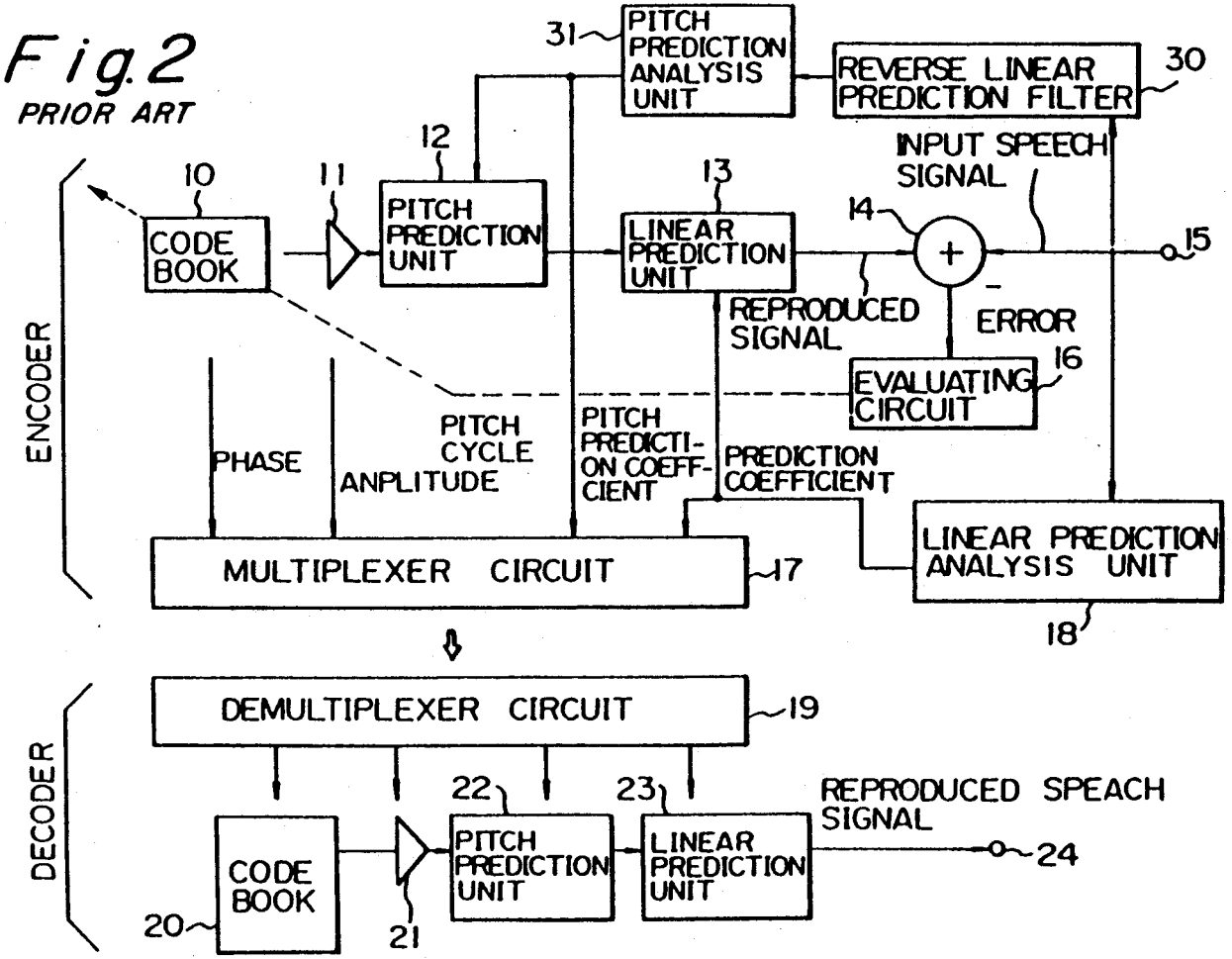
Fig. 2 PRIOR ART

Further, while not shown in the embodiment, in the same way as in FIG. 2, use is made of a linear prediction analysis unit 18, reverse linear prediction unit filter 30, and pitch prediction analysis unit 31, of course.

Figure 3:
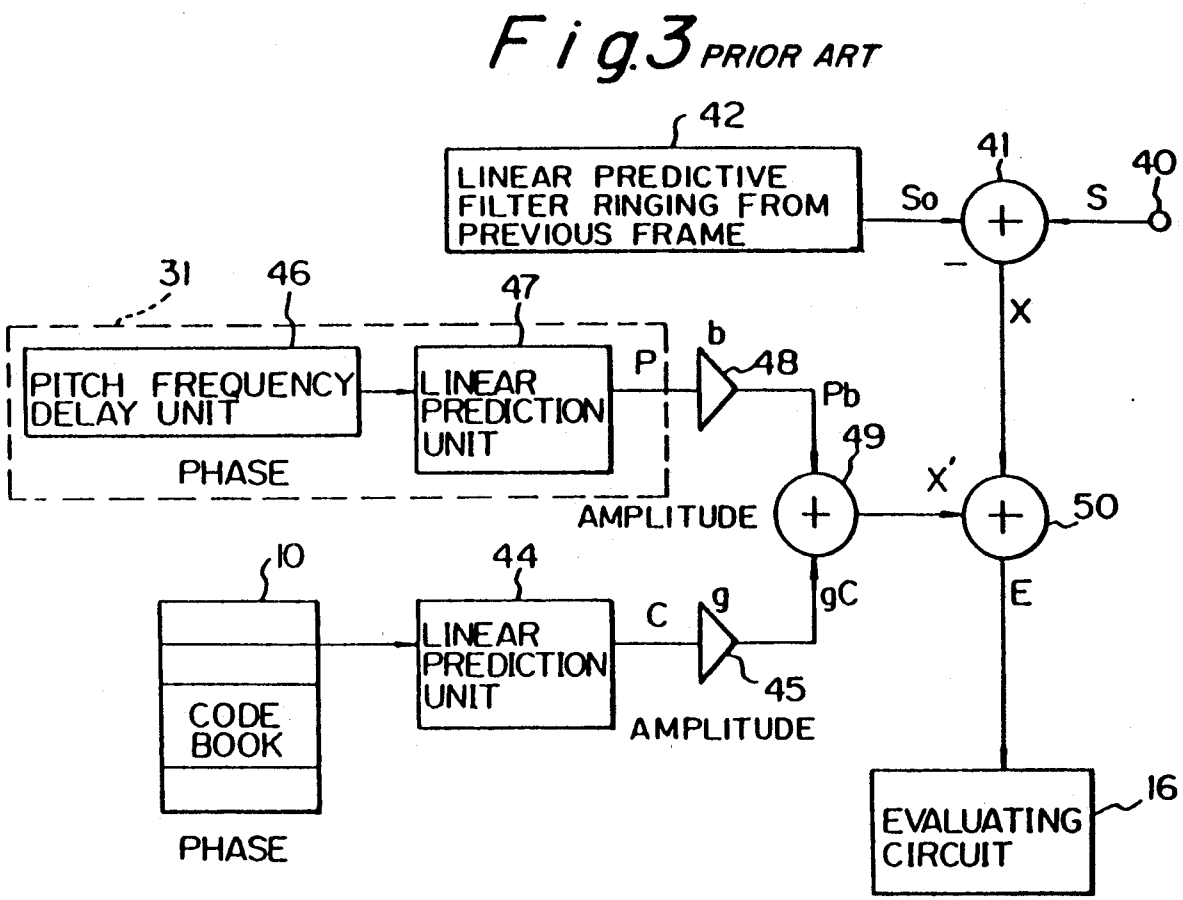
Fig.3 PRIOR ART
FIGS. 3 and 4 are views for explaining the method of analysis in the system of the related art.
Figure 4:
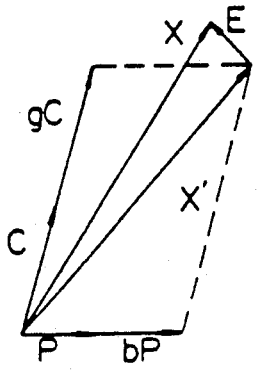
Fig.4 PRIOR ART
Figure 6:
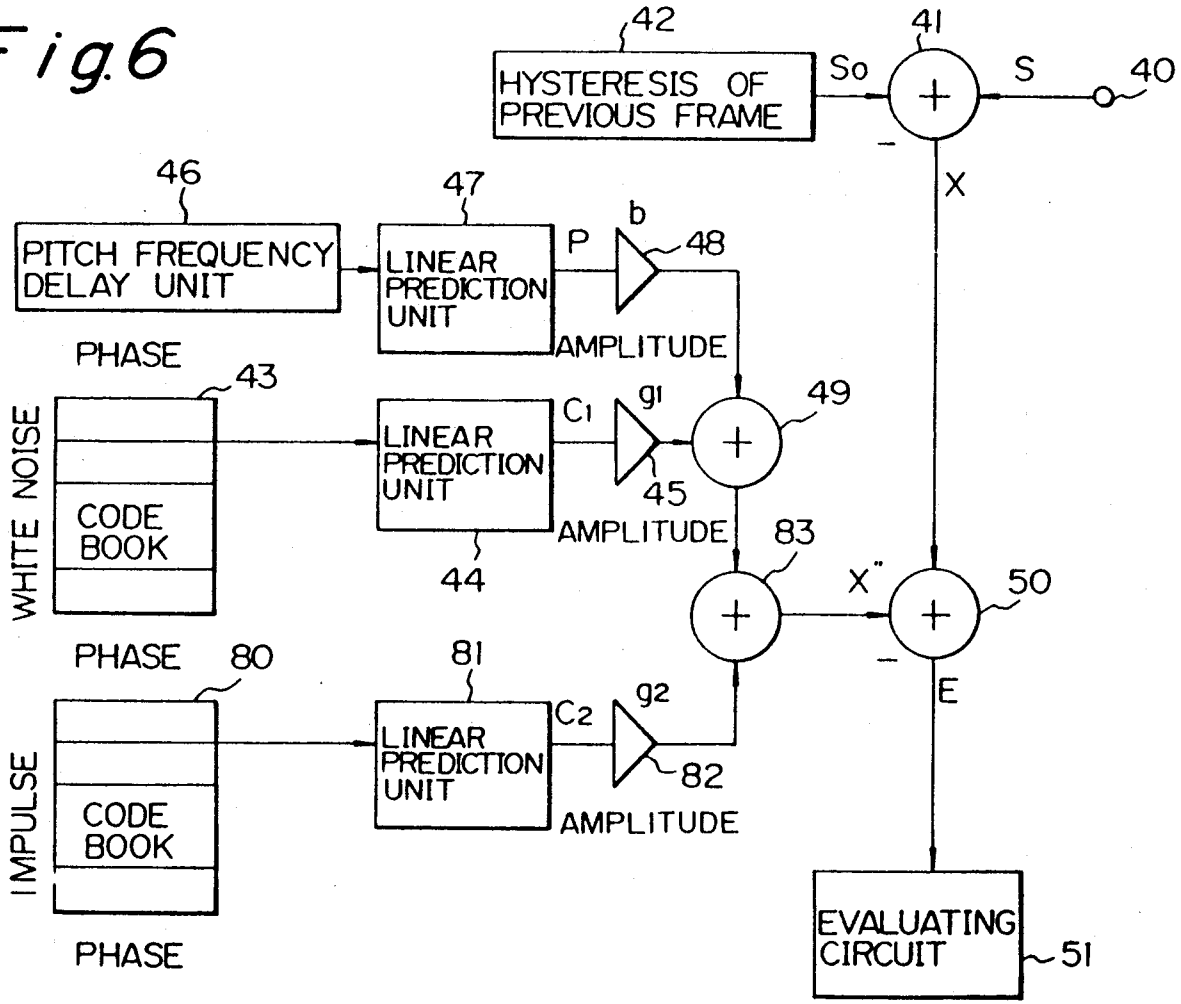
FIG. 6 is a circuit diagram for realization of the embodiment shown in FIG. 5.

FIG. 6 shows an example of the circuit constitution for realizing the above embodiment according to the speech coding system of the present invention. In FIG. 6, portions the same as in FIG. 3 are given the same reference numerals and explanations thereof are omitted.

Figure 7:
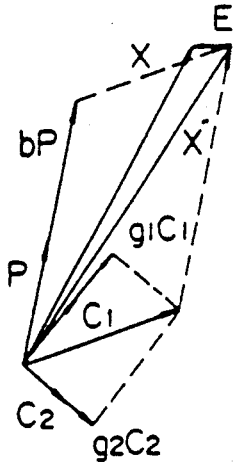
FIG. 7 is a view showing the method of analysis according to the system of the present invention.

In FIG. 6, a vector of a residual signal of white noise from a first code book 43 is subjected to prediction by a linear prediction unit 44 and multiplied with a gain $g_1$ by a multiplier unit 45, one example of a variable gain circuit, to obtain a white noise code vectors $g_1C_1$. Further, the vectors of residual signals of impulses from a second code book 80 are subjected to prediction by a linear prediction unit 81 and multiplied by a gain $g_2$ by a multiplier unit 82, similarly an example of a variable gain circuit, to obtain an impulse code vector $g_2C_2$. The above-mentioned code vectors $g_1C_1$ and $g_2C_2$ and a pitch prediction vector bP output from a multiplier unit 48 are added by adders 49 and 83 to give a composite vector X''. The error E between the composite vector X'' output by the adder 83 and the target vector is evaluated by an evaluating circuit 51. FIG. 7 illustrates the vector operation mentioned above.

At this time, the equation for evaluation of the error signal power $|E|^2$ is expressed by equation (4). The amplitude b of the pitch prediction vector and the amplitudes $g_1$ and $g_2$ of the code vectors giving the minimum such power are determined by equations (5), (6), and (7):

$$|E|^2 = |X - bP - g_1c_1 - g_2c_2|^2 \quad (4)$$

where, $$\partial|E|^2/\alpha b=0$$

$$\partial|E|^2/\alpha g_1=0$$

$$\partial|E|^2/\alpha g_2=0$$

By this, $$b=\{(Z5XZ6XZ7+Z2XZ4XZ9+Z3XZ4XZ8)-(Z3XZ5XZ9+Z4XZ4XZ7+Z2XZ6XZ8)\}/\Delta \quad (5)$$

$$g_1=\{(Z1XZ6XZ8+Z3XZ4XZ7+Z2XZ3XZ9)-(Z3XZ3XZ8+Z1XZ4XZ9+Z2XZ6XZ7)\}/\Delta \quad (6)$$

$$g_2=\{(Z1XZ5XZ9+Z2XZ3XZ8+Z2XZ4XZ7)-(Z3XZ5XZ7+Z2XZ2XZ9+Z1XZ4XZ8)\}/\Delta \quad (7)$$

$$\Delta=Z1XZ5XZ6+2XZ2XZ3XZ4-Z3XZ3XZ5-Z1XZ4XZ4-Z2XZ2XZ6$$

where, $Z1=(P, P)$, $Z2=(P, C_1)$,
$Z3=(P, C_2)$, $Z4=(C_1, C_2)$,
$Z5=(C_1, C_1)$, $Z6=(C_2, C_2)$,
$Z7=(X, P)$, $Z8=(X, C_1)$,
$Z9=(X, C_2)$ Therefore, to determine the most suitable code vector and pitch prediction vector, one may find the amplitudes $g_1$, $g_2$, and b by the equations (5), (6), and (7) for all the combinations of the phases $C_1$, $C_2$, and P of the three vectors and search for the set of the amplitudes and phases $g_1$, $g_2$, b, $C_1$, $C_2$, and P giving the smallest error signal power.

Here, the phase of the impulse code vector $C_2$ corresponds unconditionally to the phase of the white noise code vector $C_1$, so to determine the optimum drive source vector, one may find the b, $g_1$, and $g_2$ giving the value of 0 for the error power $|E|^2$ partially differentiated by b, $g_1$, and $g_2$ for all combinations of the phases $(P,C_1)$ of the white noise code vector $C_1$ and the pitch prediction vector P and thereby find amplitudes b, $g_1$, and $g_2$) by equations (5) to (7) and search for the set of amplitudes and phases (b, $g_1$, $g_2$, P, $C_1$) giving the smallest error signal power of equation (4).

In this way, it is possible to identify input speech signals by adding a periodic pulse serving as a sound source of voiced speech sounds missing in the white noise code book.

Figure 8:
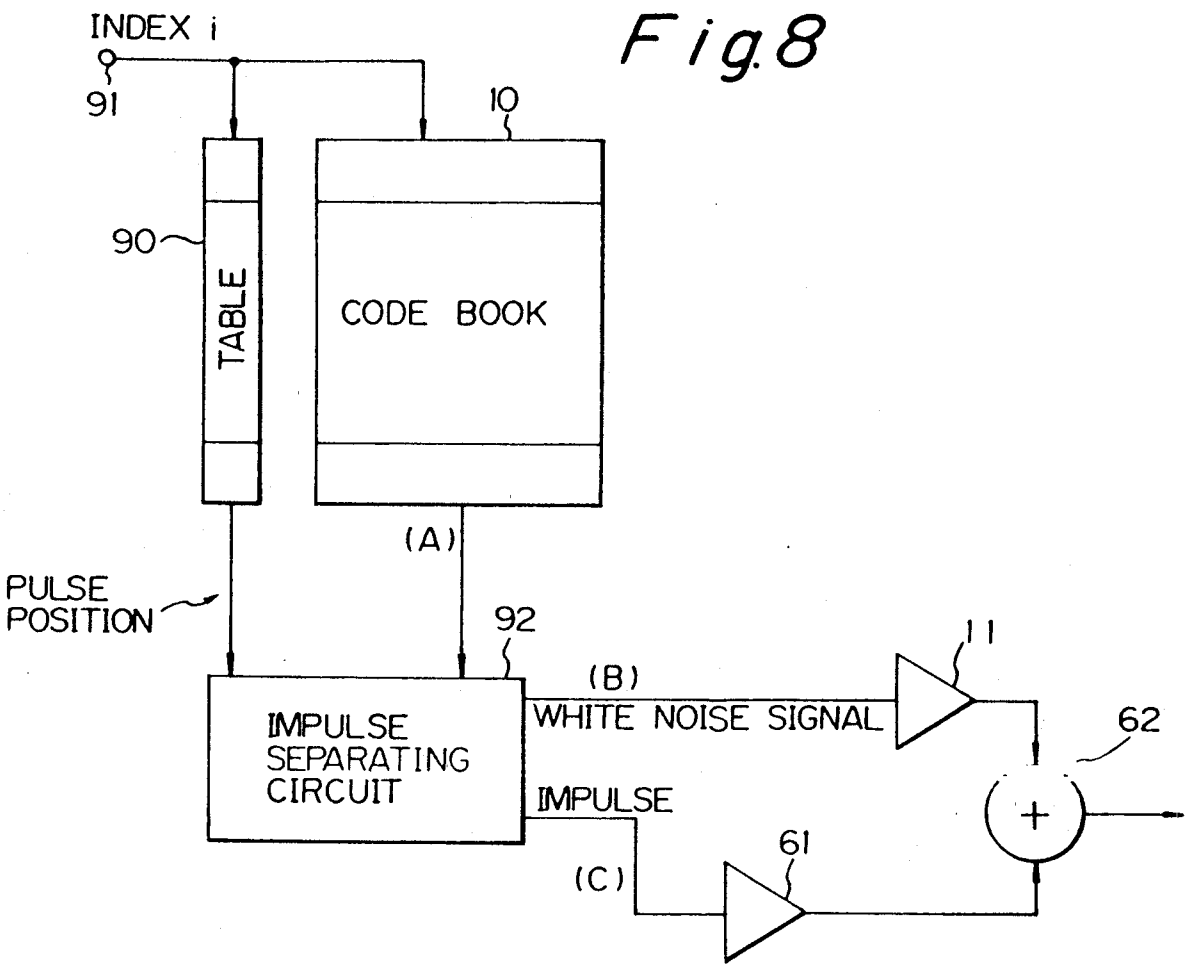
FIG. 8 is a block diagram of part of another embodiment of the system of the present invention.

FIG. 8 shows the case of establishment of an impulse vector at a pulse position showing the maximum amplitude in the white noise residual vector, with respect to the impulse vectors and the white noise residual vectors stored in the first code book in the present invention. In FIG. 8, the first code book 10 is provided with a table 90 with a common index i (corresponding to the second code book) and stores the position of the elements (sample) with the maximum amplitudes among the patterns of white noise vectors of the code book 10. The white noise vector and maximum amplitude position read out from the code book 10 and the table 90 respectively in accordance with the search pattern indexes entering from the evaluating circuit 16 through a terminal 91 are supplied to an impulse separating circuit 92 where, as shown in FIG. 9(A), just the maximum amplitude position sample is removed from the white noise vector. So, the white noise vector shown in FIG. 9(B) of the figure which has a plurality of amplitude values at each of the sampling position except the maximum amplitude value at the sampling position in which the maximum amplitude value was obtained and the amplitude value is shown as "0" at the sampling position, and the impulse shown in FIG. 9(C) of the figure which only has a maximum amplitude value at the sampling position and no other amplitude value is shown at any other remaining sampling position, are be generated and supplied respectively to the multiplier units 11 and 61, and the code book 60 thus eliminated. Of course, the same applies to the code books 20 and 70. In this case, the sum of the white noise vector and the impulse vector output by the impulse separating circuit 92 becomes the same as the original white noise vector of the code book 10, so when the amplitude ratio $g_1/g_2$ of the multiplier units 11 and 61 is "1", use may be made of the original white noise and when it is "0" use may be made of the complete impulse.

By so making the phase of the impulse vector correspond unconditionally to the white noise vectors, the need for transmission of the phase-2 of the impulse code vector is eliminated and the effect of data compression is increased.

Since the white noise vector and the impulse vector are added by varying the gain of the amplitudes of the respective elements, it is possible to accurately identify and code not only the white noise-like sound source of unvoiced speech sounds, but also the periodic pulse series sound source of voiced speech sound, a problem in the past, and thereby to vastly improve the quality of the reproduced speech.

In the embodiment of FIG. 6, the first addition circuit is formed by an adder 49 and an adder 83, but the first addition circuit may be formed by a single unit instead of the adders 49 and 83.

Figure 10:
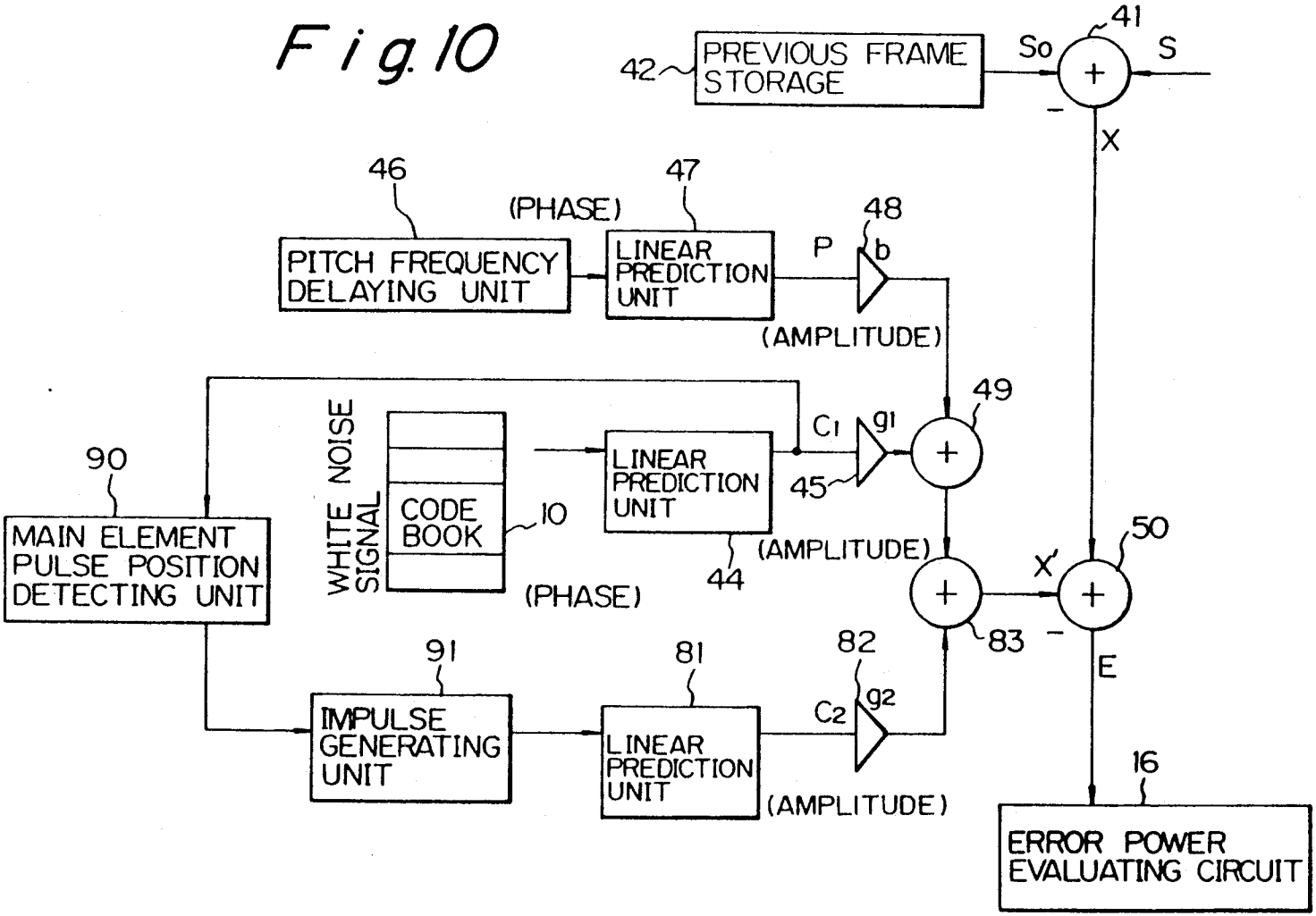
FIG. 10 is a circuit diagram showing another embodiment of the present invention.

Next, another embodiment of the speech coding system of the present invention will be shown in FIG. 10.

In FIG. 6, provision was made of a code book comprised of fixed impulses generated in accordance with only predetermined pulse positions of the vectors in the code book 10, but even if the input speech signal is identified by adding the vector based on the fixed impulses to the conventional pitch prediction vector and white noise vector, the optimal identification cannot necessarily be performed. This is because, as shown in FIG. 6, since linear prediction is applied even to the impulse vector, there is a distortion in space.

Therefore, in the third embodiment, the principle of which is shown in FIG. 10, instead of using fixed impulse vectors, the phase difference between the white noise vector $C_1$ after application of linear prediction 44 and the vector obtained by applying linear prediction to the impulse by the main element pulse position detection circuit 90 is evaluated, whereby the position of the main element pulse is detected. The main element impulse is generated at this position by the impulse generating unit 91. The three vectors, i.e., the pitch prediction vector P, the white noise code vector $C_1$, and the main element impulse vector are added and the composite vector is used to identify the input speech signal S.

Further, even in the third embodiment, a search is made for the set of the amplitudes and phases (b, $g_1$, $g_2$, P, $C_1$) giving the smallest error signal power by equations (4) to (7).

Figure 11:
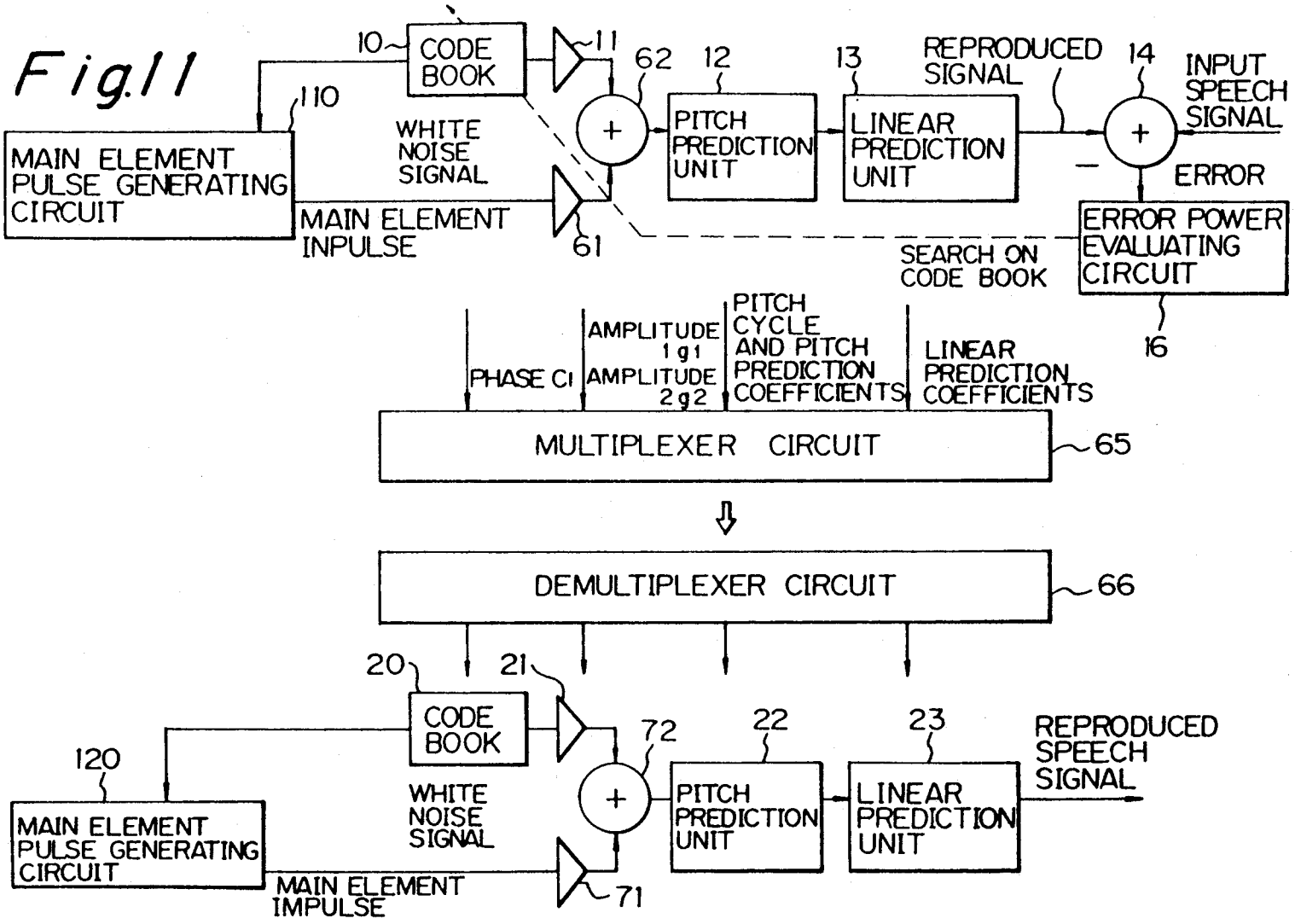
FIG. 11 is a block diagram of the other embodiment of the present invention shown in FIG. 10.

FIG. 11 is a block diagram of the third embodiment of the present invention. The third embodiment differs from the embodiment of FIG. 5 only in that it uses a main element pulse position detection circuit 110 instead of an impulse code book 60.

That is, the main element pulse position detection circuit 110 extracts the position of the main element pulse for the vectors of the white noise code book 10, the main element pulse generated at that position is multiplied by the gain (amplitude) component by the multiplier unit 61, one type of variable gain circuit, then is added to the white noise read out from the code book 10 as in the past and multiplied by the gain by the multiplier unit 11, also one type of variable gain circuit, and reproduction is performed by the pitch prediction unit 12 and the linear prediction unit 13.

Further, since the independent variable gains are multiplied with the white noise and the main element impulse, the coding information may be, like with FIG. 5, the white noise code index (phase) and gain (amplitude), the amplitude of the main element impulse, and the parameters for constructing the prediction units (pitch frequency, pitch prediction coefficient, linear prediction coefficient) transmitted multiplexed by the multiplexer circuit 65. Further, the receiving side may be similarly provided with a main element pulse position detection circuit 120 and the speech signal reproduced based on the parameters demultiplexed at the demultiplexer circuit 66.

Therefore, since the sound source signal is generated by adding the white noise and the impulse, it is possible to accurately generate not only a white noise-like sound source of unvoiced speech sounds, but also a periodic pulse series sound source of voiced speech sounds by control of the amplitude components and therefore possible to improve the quality of the reproduced speech.

Figure 12:
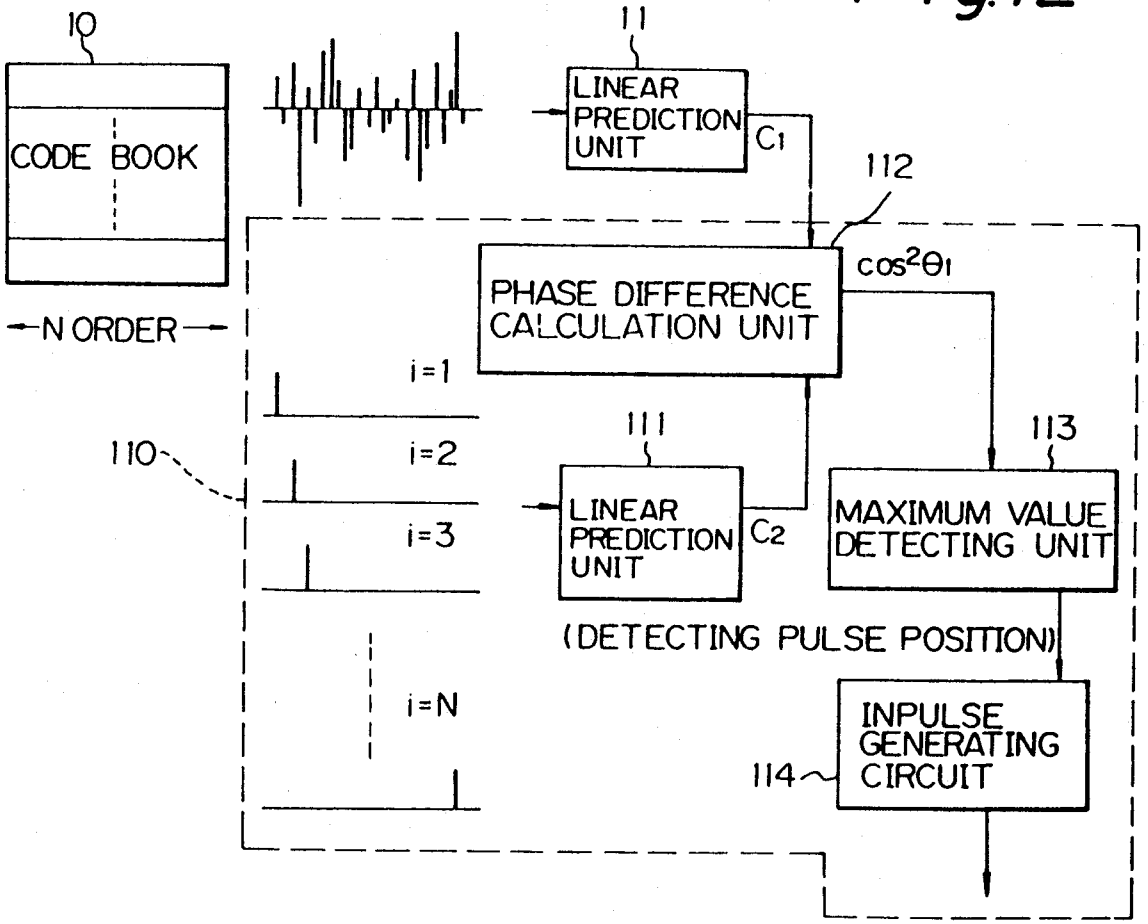
FIG. 12 is a view of an example of a main element pulse position detecting circuit used in the other embodiment of the present invention shown in FIG. 10.

FIG. 12 shows an embodiment of the main element pulse position detection circuit 110 used in the above-mentioned embodiment. In this embodiment, provision is made of a linear prediction unit 111 which applies linear prediction to N number of impulse vectors (these may be generated also from a separately provided memory) with different pulse positions, a phase difference calculation unit 112 which calculates a phase difference between a code vector $C_1$ obtained by applying linear prediction to the white noise of the code book 10 by the linear prediction unit 11 and an impulse code vector $C_2^i$ (where $i=1, 2, \ldots N$) to which linear prediction from the linear prediction unit 111 is applied, a maximum value detection unit 113 which detects the maximum value of the phase difference calculated by the phase difference calculation unit 112, and an impulse generating circuit 114 which decides on the position of the main element pulse by the maximum value detected by the maximum value detection unit 113 and generates an impulse at the position of the main element pulse.

In such a main element pulse position detection circuit 110, the impulse code vector is sought giving the minimum phase difference $\theta_i$ between the code vector $C_1$ obtained by applying linear prediction to the vectors stored in the code book 10 and the N number of impulse code vectors $C_2^i$, that is, giving the maximum value of $$\cos^2\theta_i=(C_1,C_2^i)^2/\{(C_1,C_1)\cdot(C_2^i,C_2^i)\},$$

thereby enabling determination of the position of the main element pulse.

In this case, by providing a main element pulse position detection circuit even on the decoder side, it is possible to extract the phase information of the main element pulse from the phase of the code vector even without transmission of the same and therefore it is possible to improve the characteristics by an increase of just the amplitude information of the main element pulse.

According to the above explained first to third embodiments, in addition to the addition of two vectors, i.e., the white noise code vector and the pitch prediction vector, an impulse code vector generated by a code book or table etc. at a position corresponding to the position of predetermined pulses of the white noise code vector is added and the identification performed by this composite vector of three vectors, so it is possible to create not only a sound source of unvoiced speech sounds, but also a pulse-like sound source of voiced speech sounds and possible to improve the quality of the reproduced speech. Further, by separating the vector of the residual signal of the impulse from the vector of the residual signal of the white noise, it is possible to increase the effect of data compression.

Further, according to the above embodiment, it is possible to control the amplitude of the elements by combining the white noise vector and the impulse vector corresponding to the main element, so it is possible to create a more effective pulse sound source than even with generation of a fixed impulse.

Next, an explanation will be made of a fourth embodiment of the speech coding system of the present invention. The fourth embodiment of the present invention constitutes the conventional CELP type speech coding system wherein the vector of the residual signal of the white noise and the vector of the residual signal of the impulse are added by a ratio based on the strength of the pitch correlation of the input speech signal obtained by pitch prediction so as to obtain a composite vector. The composite vector is reproduced to obtain a reproduced signal and the error of that with the input speech signal is evaluated.

Therefore, in the fourth embodiment, since the vector of the residual signal of the white noise and the vector of the residual signal of the impulse are added by a ratio based on the strength of the pitch correlation of the input speech signal and the composite vector is reproduced, it is possible to accurately identify and code not only the white noise-like sound source of unvoiced speech sounds, but also the periodic pulse series sound source of voiced speech sounds and thereby to improve the quality of the reproduced speech.

Figure 13:
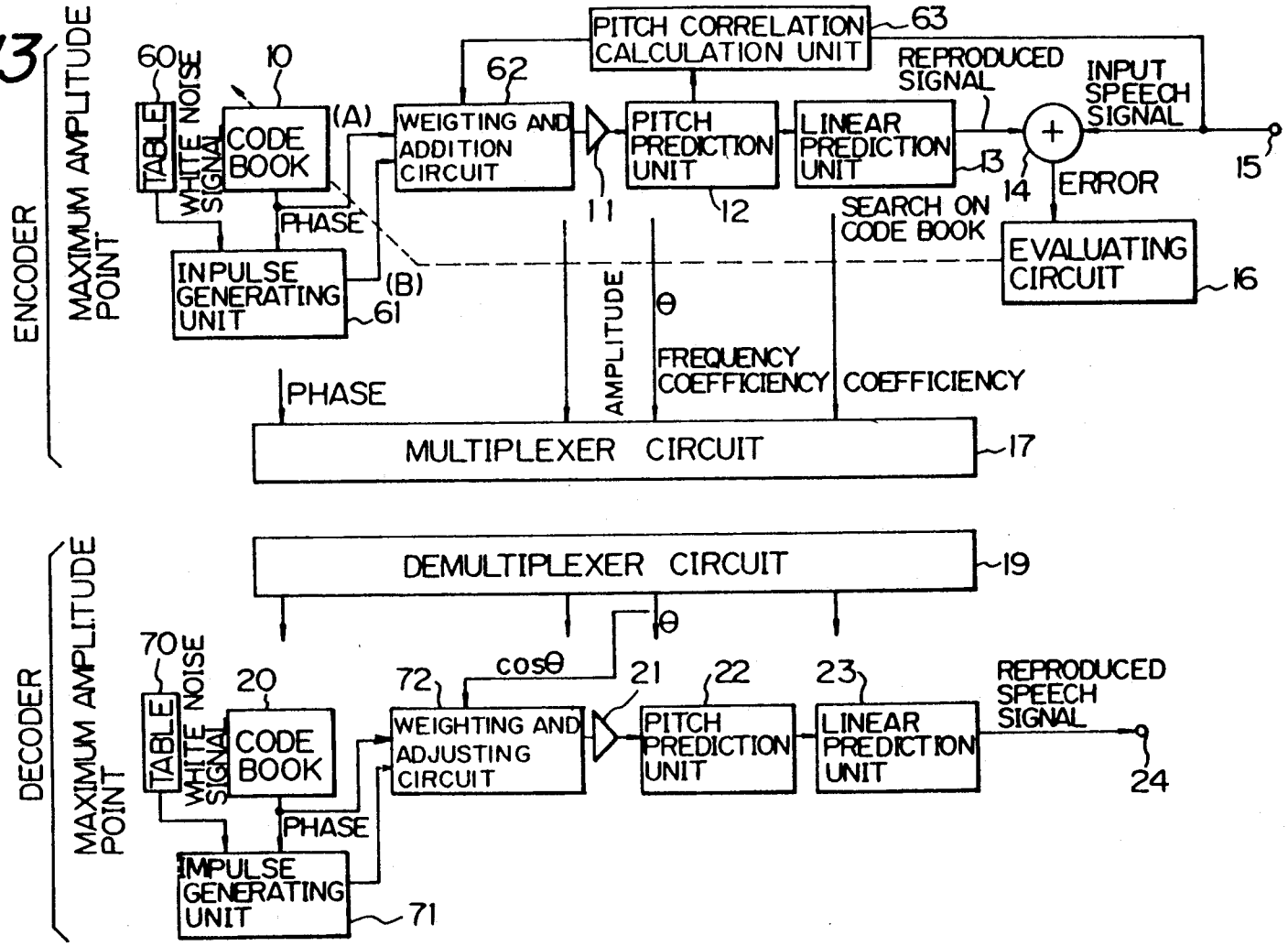
FIG. 13 is a block diagram showing another embodiment of the present invention.

FIG. 13 is a block diagram of the fourth embodiment of the system of the present invention. In the figure, portions the same as FIG. 1 are given the same reference numerals and explanations thereof are omitted.

In FIG. 13, there is additionally provided a table 60 in the code book 10 in which are stored $2^m$ patterns of N order vectors of residual signals of white noise. In this table 60 are stored the positions of elements (samples) of the maximum amplitude for each of the $2^m$ patterns of vectors in the code book 10.

The white noise vector read out from the code book 10 in accordance with the search pattern index from the evaluating circuit 16 is supplied to the impulse generating unit 61 and the weighting and addition circuit 62, while the maximum amplitude position read out from the table is supplied to the impulse generating unit 61.

The impulse generating unit 61 picks out the element of the maximum amplitude position from in the white noise vector as shown in FIG. 14(A) and generates an impulse vector as shown in FIG. 14(B) with the remaining N-1 elements all made 0 and supplies the impulse vector to the weighting and addition circuit 62.

The weighting and addition circuit 62 multiplies the weighting $\sin\theta$ and $\cos\theta$ supplied from the later mentioned pitch correlation calculation unit 63 with the white noise vector and impulse vector for performing the weighting, then performs the addition. The composite vector obtained here is supplied to the multiplier unit 11.

The code vector gC becomes equal to the impulse vector when the pitch correlation is maximum ($\cos\theta=1$) and becomes equal to the white noise vector when the pitch correlation becomes minimum ($\cos\theta=0$). That is, the property of the code vector may be continuously changed between the impulse and white noise in accordance with the strength of the pitch correlation of the input speech signal, whereby the precision of identification of the sound source with respect to an input speech signal can be improved.

The pitch correlation calculation unit 63 finds the phase difference $\theta$ between the later mentioned pitch prediction vector and the vector of the input speech signal to obtain the pitch correlation (weighting) $\cos\theta$ and the weighting $\sin\theta$.

The evaluating circuit 16 searches through the code book 10 and decides on the index giving the smallest error signal power. The index of the code book 10 decided on, that is, the phase of the residual vector of the white noise, the gain, that is, the amplitude of the residual vector, of the multiplier unit 11, the frequency and coefficient ($\lambda$ and $\cos\theta$) of the pitch prediction unit 12 as in the past, and the coefficient of the linear prediction unit 13 are transmitted multiplexed by the multiplexer circuit 17. In this embodiment too, the gain is preferably variable.

The transmitted multiplexed signal is demultiplexed by the demultiplexer circuit 19. The code book 20 and the table 70 are each of the same construction as the code book 10 and the table 60. The vector and maximum amplitude position indicated by the respective indexes (phases) are read out from the code book 20 and the table 70.

The impulse generating unit 71 generates an impulse vector in the same way as the impulse generating unit 61 on the coding unit side and supplies the same to the weighting circuit 72. The weighting circuit 72 prepares the weighting $\sin\theta$ from the pitch correlation (weighting) $\cos\theta$ from among the coefficients ($\lambda$ and $\cos\theta$) from the pitch prediction unit 12 transmitted and demultiplexed. With these, the white noise vector and the impulse vector are weighted and added and the composite vector is supplied to the multiplier 21. Reproduction is performed at the pitch prediction unit 22 and the linear prediction unit 23.

Figure 16:
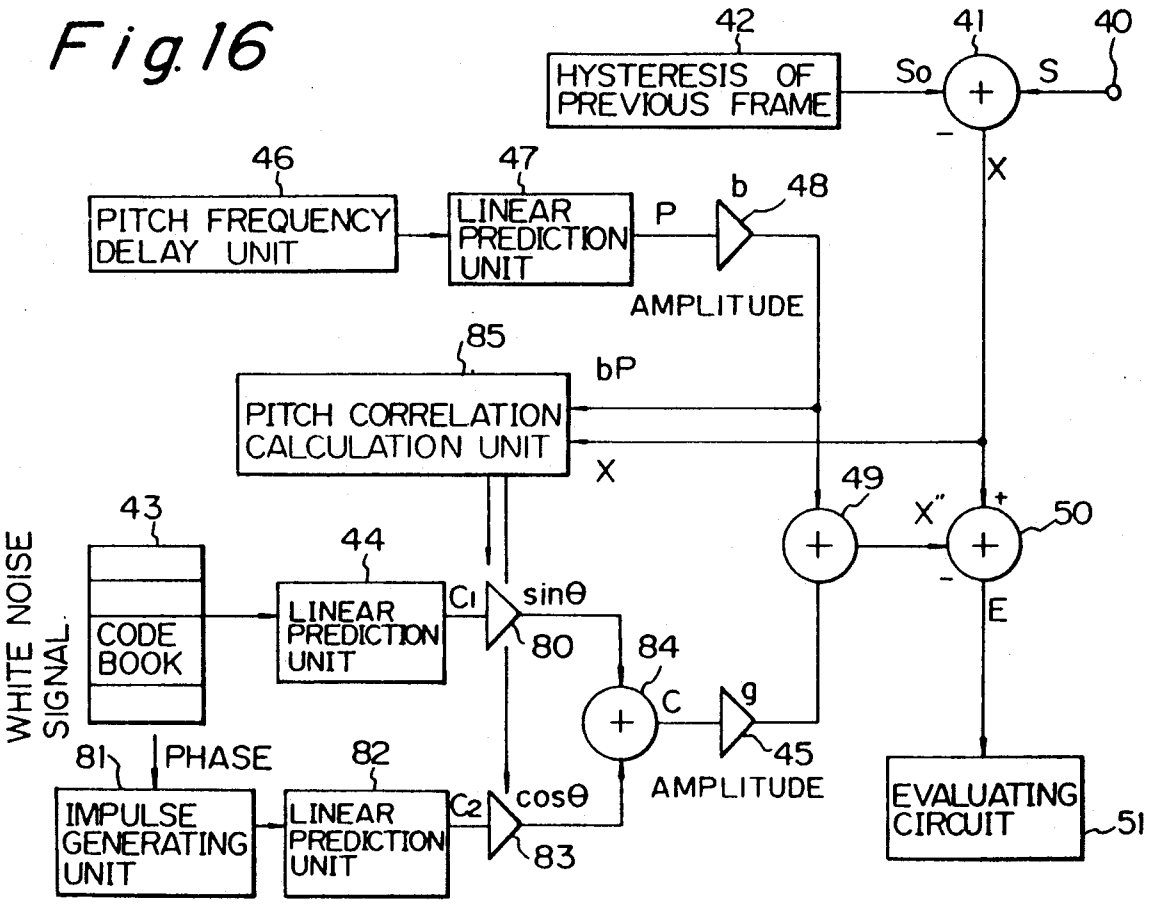
FIG. 16 is a view showing an example of the circuit for realizing the other embodiment of the present invention shown in FIG. 13.

The circuit construction of the speech coding system of the above embodiment may be expressed as shown in FIG. 16. In FIG. 16, portions the same as in FIG. 2 are given the same reference numerals and explanations thereof are omitted.

In FIG. 16, the vector of the residual signal of the white noise from the code book 43 is subjected to prediction by the linear prediction unit 44 and multiplied with the weighting $\sin\theta$ by the multiplier unit 80, one type of variable gain circuit, to obtain a white noise code vector. Further, the vector of the residual signal of the impulse generated from the white noise vector at the impulse generating unit 81 is subjected to prediction by the linear prediction unit 82 and multiplied by the weighting $\cos\theta$ by the multiplier 83, one type of variable gain circuit, to obtain an impulse code vector. These are added by the adder 84 and further multiplied by the gain g at the adder 45 (amplitude of code vector) to give the code vector gC. This code vector gC is added by the adder 49 with the pitch prediction vector bP output from the multiplier unit 48 and the composite vector X″ is obtained. The error E between the composite vector X″ output by the adder 50 and the target vector X is evaluated by the evaluating circuit 51. FIG. 17 illustrates this vector operation.

In this case, the code vector gC changes in accordance with the weighting $\cos\theta$, $\sin\theta$ from white noise to an impulse, but the pitch prediction vector bP and the code vector gC may be used to determine the phases P and C and amplitudes b and g of the two vectors in the same way as the past without change to the process of identification of the input.

Figure 15A:
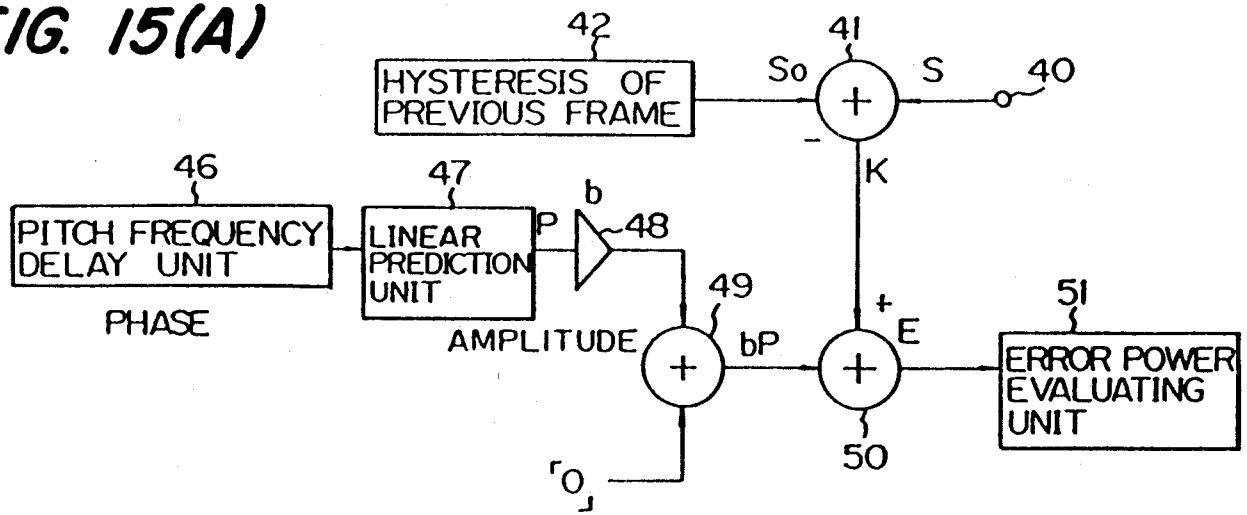
FIGS. 15(A) and (B) are views for explaining the method of calculation of the pitch correlation of the embodiment of FIG. 13.
Figure 15B:
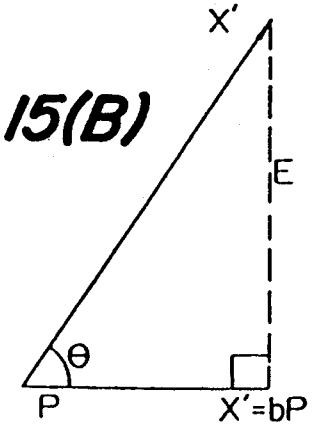

Here, an explanation will be made of the pitch correlation calculation unit 85 together with FIGS. 15(A) and (B). FIG. 15(A) takes out a portion of FIG. 16.

The amplitude component b of the pitch prediction vector bP is nothing other than the prediction coefficient b of the pitch prediction unit, but this value may be found by identifying the input signal by only the pitch prediction vector using the code vector gC as "0" in the above-mentioned speech signal analysis (equation (8) and equation (9)). Here, the pitch prediction coefficient b, as shown in equation (10), is the product of the amplitude ratio $\lambda$ of the target vector X and the pitch prediction vector P and the pitch correlation $\cos\theta$. The value of the pitch correlation is maximum ($\cos\theta=1$) when the phase of the pitch prediction vector matches the phase of the target vector ($\theta=0$). The larger the phase difference $\theta$ of the two vectors, the smaller this is. Further, the value is also the value showing the strength of the periodicity of the speech signal, so it is possible to use this to control the ratio of the white noise element and the impulse element in the speech signal. FIG. 17 illustrates the above-mentioned vector operation.

$$|E|^2=|X-bP|^2 \tag{8}$$

where, $\partial|E|^2/\partial b=0$

By this, $$b=(X.P)/(P.P) \tag{9}$$

$$b=\lambda\cdot\cos\theta \tag{10}$$

where, $\lambda$ is the amplitude ratio and $\theta$ is the phase difference and $$\lambda=|X|/|P|$$

In this way, the white noise vector and the impulse vector are added with the amplitudes of their respective elements controlled, so it is possible to accurately identify and code not only the white noise-like sound source of unvoiced speech sounds, but also the periodic pulse series sound source of voiced speech sounds, a problem in the past, and thereby to vastly improve the quality of the reproduced speech.

Further, the phase of the impulse vector added to the white noise vector is made to correspond unconditionally to the phase of the white noise and even the strength of the pitch correlation $\cos\theta$ is transmitted as the pitch prediction coefficient ($b=\lambda\cdot\cos\theta$), so there is no increase in the amount of information transmitted compared with the conventional system.

Note that the drawing of a correspondence between the phases of the impulse vectors and the phases of the white noise vectors is not limited to the above-mentioned maximum amplitude position.

As mentioned above, according to the speech coding system of this embodiment, it is possible to accurately identify and code not only the sound source of unvoiced speech sounds but also the pulse-like sound source of voiced speech sounds, not possible in the past, and is possible to improve the quality of the reproduces signal. Further, there is no increase in the amount of the information transmitted, making this very practical.

That is, in the embodiment, not all the information on the gain (amplitude) and residual vectors (phase) is transmitted, so transmission is possible with the information compressed. It is possible to freely select fro the above plurality of embodiments, in accordance with the desired objective, in this invention, where there is never any deterioration of the quality of the reproduced signal. For example, when desiring to obtain a compression effect without increasing the amount of information, use may be made of the second and third embodiments, while when desiring to obtain a compression effect even at the expense of the characteristics of the reproduced speech, use may be made of the fourth embodiment.

We claim:

1. A method of encoding and transmitting an input speech signal by code excited linear prediction type encoding to provide a decodable signal, said method comprising the steps of:

(a) providing a residual signal vector from a white noise code book, based on an error signal so as to reduce the error signal, (b) applying linear prediction to the white noise residual signal vector to obtain a code vector and a first coefficient, (c) applying linear prediction to a residual signal of a previous speech signal delayed by a pitch frequency to obtain a pitch prediction vector and a second coefficient, (d) providing an impulse residual signal vector having a predetermined relationship with the residual signal vector from the white noise code book, (e) applying linear prediction to the impulse residual signal vector provided in step (d) to obtain an impulse vector and a third coefficient, (f) applying variable gains to at least the code vector obtained by said step (b) and the impulse vector obtained by said step (e), (g) adding the code, pitch prediction and impulse vectors after applying the variable gains in step (f) to form a reproduced signal, (h) evaluating a difference between the reproduced signal formed by said step (g) and the input speech signal to provide the error signal for said step (a), and (i) transmitting a decodable signal based on at least the first, second and third coefficients.

2. A method according to claim 1, wherein respective impulse residual signal vectors provided in said step (d) correspond to the residual signal vectors of the white noise code book.

3. A method according to claim 2, wherein the impulse residual signal vector provided in step (d) corresponds to predetermined pulse positions in the residual signal vectors of the white noise code book.

4. A method according to claim 2, wherein the impulse residual signal vectors provided in step (d) correspond to pulse positions of a maximum amplitude in the white noise residual signal vectors of the code book.

5. A method according to claim 4, wherein the impulse residual signal vectors provided in said step (d) and the pulse positions of the maximum amplitude are stored in a separately provided code book.

6. A method according to claim 2, wherein the impulse residual signal vectors provided in said step (d) and pulse positions of a maximum amplitude are stored in a separately provided code book.

7. A method according to claim 1, wherein the impulse residual signal vectors provided in said step (d) having a predetermined relationship with the code vector of the code book are main element impulses in the white noise residual signal vectors of the code book.

8. A method according to claim 1, further comprising the step of:

(j) adjusting the white noise residual signal vector and the impulse residual signal vector by a predetermined coefficient derived from a vector of the input speech signal and the pitch prediction vector obtained by said applying linear prediction to a residual signal of a preceding frame.

9. A method according to claim 8, further comprising the step of:

(k) weighting the white noise residual signal vector and the impulse residual signal vector by a predetermined coefficient derived from the vector of the input speech signal and the pitch prediction vector obtained by said applying linear prediction to a residual signal of a preceding frame.

10. A method according to claim 9, further comprising the steps of:

(l) adding the white noise residual signal vector and the impulse residual signal vector in a ratio according to an intensity of a pitch correlation obtained by applying linear prediction to the vector of the input speech signal and the pitch prediction vector obtained by said applying linear prediction to a residual signal of a preceding frame.

11. A method according to claim 10, wherein the pitch correlation in said step (l) is a function of angle.

12. A method according to claim 1, wherein the impulse residual signal vector is separated from the white noise residual signal vector.

13. An apparatus for encoding and transmitting an input speech signal, comprising:

a pitch frequency delay circuit to delay a residual signal of a previous speech signal by a pitch frequency, a code book to store a plurality of white noise residual signal vectors, an impulse generating circuit to generate an impulse having a predetermined relationship with the white noise residual signal vectors stored in said code book, a linear prediction circuit operatively connected to said pitch frequency delay circuit, said code book, and said impulse generating circuit to output vectors and a coefficient, a variable gain circuit operatively connected to said linear prediction circuit to apply a variable gain to at least one of the output vectors of said linear prediction circuit, a first addition circuit operatively connected to said variable gain circuit to produce a reproduced composite vector, a second addition circuit operatively connected to said first addition circuit to add the reproduced composite vector and a vector of the input speech signal to output an error signal, an evaluating circuit operatively connected to said second addition circuit and said code book to identify a white noise residual signal vector stored in said code book in response to the error signal, and an output transmitter operatively connected to at least said linear prediction circuit to transmit a decodable signal based on at least the coefficient.

14. An apparatus according to claim 13, wherein said linear prediction circuit comprises a first linear prediction unit operatively connected to said pitch frequency delay circuit to provide a pitch prediction vector, a second linear prediction unit operatively connected to said code book to provide a white noise prediction vector and a third linear prediction unit operatively connected to said impulse generating circuit to provide an impulse prediction vector;

wherein said first addition circuit includes:

a first adder operatively connected to said first and second linear prediction units to add the pitch and white noise prediction vectors to produce a sum vector, and a second adder operatively connected to said third linear prediction unit and said first adder to add the impulse prediction vector and the sum vector to produce the reproduced composite vector.

15. An apparatus according to claim 13, wherein said linear prediction circuit comprises a first linear prediction unit operatively connected to said pitch frequency delay circuit to provide a pitch prediction vector, a second linear prediction unit operatively connected to said code book to provide a white noise prediction vector and a third linear prediction unit operatively connected to said impulse generating circuit to provide an impulse prediction vector; and wherein said apparatus further comprises a main element pulse position detection circuit operatively connected to said impulse generating circuit and said second linear prediction unit to drive said impulse generating circuit in response to the white noise prediction vector output from said second linear prediction unit.

16. An apparatus according to claim 15, wherein said main element pulse position detection circuit determines a pulse position allowing a smallest phase error between the white noise prediction vector and the impulse prediction vector, the impulse prediction vector obtained by applying linear prediction in said third linear prediction unit to one pulse from said impulse generating circuit which is corresponding to sample times of residual signal vector stored in said code book.

17. An apparatus according to claim 13, wherein said impulse generating circuit comprises another code book to store a plurality of impulses corresponding to the white noise residual signal vectors stored in said code book.

18. An apparatus according to claim 17, wherein said another code book stores the impulses in an order representative of maximum pulses in the white noise residual signal vectors stored in said code book.

19. An apparatus according to claim 17, wherein said impulse generating circuit includes an impulse separating circuit which separates the impulses from the vectors of white noise residual signal vectors stored in said code book.

20. An apparatus according to claim 13, wherein said linear prediction circuit comprises a first linear prediction unit operatively connected to said pitch frequency delay circuit to provide a pitch prediction vector, a second linear prediction unit operatively connected to said code book to provide a white noise prediction vector and a third linear prediction unit operatively connected to said impulse generating circuit to provide an impulse prediction vector;

wherein said variable gain circuit comprises a first variable gain unit operatively connected to said second linear prediction unit to apply a first variable gain to the white noise prediction vector and a second variable gain unit operatively connected to said third linear prediction unit to apply a second variable gain to the impulse prediction vector; and wherein said apparatus further comprises a weighting circuit operatively connected to said first and second variable gain units to control said first and second variable gain units, and a pitch correlation calculating circuit operatively connected to said weighting circuit and at least said first linear prediction unit to receive the pitch prediction vector from said first linear prediction unit and to control said first and second variable gain units.

21. An apparatus for encoding and transmitting an input speech signal to provide a decodable signal, comprising:

first code book means for storing first data and generating a white noise signal based on the stored first data and an index;

second code book means for storing second data and generating an impulse signal based on the stored second data and the index;

linear prediction means for applying linear prediction to the white noise and impulse signals and generating a coefficient;

processing means for comparing the white noise and impulse signals with the input speech signal to provide an error signal;

evaluating means for generating the index based on the error signal; and transmitting means for transmitting a decodable signal based on at least the coefficient.

22. An apparatus according to claim 21, wherein said processing means comprises:

adding means for adding the white noise and impulse signals after said linear prediction means applies linear prediction to the white noise and impulse signals; and comparing means for comparing the white noise and impulse signals after said adding means adds the white noise and impulse signals.

23. An apparatus according to claim 22, wherein said apparatus further comprises a pitch frequency delay unit operatively connected to provide a residual signal of a previous speech signal to said linear prediction means;

wherein said linear prediction means comprises means for outputting a pitch prediction vector based on the residual signal of a previous speech signal; and wherein said adding means comprises means for further adding the pitch prediction vector, the white noise and the impulse signals.

24. An apparatus according to claim 23, wherein one of the first and second code book means is a table and another of the first and second code book means is a code book; and wherein said apparatus further comprises an impulse separating circuit for receiving outputs of the table and the code book and generating the white noise and impulse signals.

25. An apparatus according to claim 24, further comprising:

hysteresis means for storing a previous speech signal; and subtractor means for subtracting the previous speech signal from a present speech signal to provide the input speech signal to said processing means.

26. An apparatus according to claim 23, further comprising:

hysteresis means for storing a previous speech signal; and subtractor means for subtracting the previous speech signal from a present speech signal to provide the input speech signal to said processing means.

27. An apparatus according to claim 26, wherein said apparatus further comprises a pitch correlation calculation unit operatively connected to said linear prediction unit and said subtractor to output weights; and wherein said linear prediction means includes multipliers operatively connected to said pitch correlation calculation unit to weight the white noise and impulse signals by the weights.

28. An apparatus according to claim 21, wherein one of the first and second code book means is a table and another is a code book; and wherein said apparatus further comprises an impulse separating circuit operatively connected to receive outputs of the table and the code book to generate the white noise and impulse signals.

29. An apparatus for encoding an input speech signal, comprising:

code book means for storing white noise data and generating a white noise signal based on the stored white noise data and an index;

impulse means for generating an impulse signal having a predetermined relationship with the white noise data stored in said code book means based on the index;

linear prediction means for applying linear prediction to the white noise and impulse signals and generating a coefficient;

processing means for comparing the white noise and impulse signals with the input speech signal to provide an error signal;

evaluating means for generating the index based on the error signal; and transmitting means for transmitting a decodable signal based on at least the coefficient.

30. An apparatus according to claim 29, wherein said apparatus further comprises pitch prediction means for applying pitch prediction to the white noise and impulse signals and generating another coefficient; and wherein said transmitting means comprises means for transmitting the decodable signal based on at least the coefficient, the another coefficient and the index.

31. An apparatus according to claim 30, wherein said processing means comprises:

adding means for adding the white noise and impulse signals before said pitch prediction means applies pitch prediction and said linear prediction means applies linear prediction; and comparing means for comparing the white noise and impulse signals after said pitch prediction means applies pitch prediction and said linear prediction means applies linear prediction.

32. A method of encoding and transmitting an input speech signal to provide a decodable signal, comprising the steps of:

(a) generating a first signal based on stored first data and an index;

(b) generating a second signal based on stored second data and the index;

(c) applying linear prediction to the first and second signals and generating third and fourth signals and a coefficient;

(d) adding the third and fourth signals to generate a fifth signal;

(e) comparing the fifth signal with the input speech signal to generate an error signal;

(f) generating the index based on the error signal; and (g) transmitting a decodable signal based on at least the coefficient.

33. A method according to claim 32, wherein the first signal is a white noise signal and the second signal is an impulse signal.

34. A method according to claim 33, further comprising the steps of:

(h) storing a previous speech signal; and (i) subtracting the previous speech signal stored in said step (h) from a present speech signal to provide the input speech signal for said comparing in said step (e).

35. An apparatus for receiving and decoding a decodable signal to reproduce a speech signal, comprising:

receiving means for receiving and demultiplexing the decodable signal to generate at least an index signal and a coefficient;

first code book means for storing first data and generating a white noise signal based on the stored first data and the index signal from the receiving means;

second code book means for storing second data and generating an impulse signal based on the stored second data and the index signal from the receiving means;

linear prediction means for applying linear prediction to the white noise and impulse signals based on the coefficient from said receiving means to reproduce the speech signal.

36. An apparatus for receiving and decoding a decodable signal to reproduce a speech signal, comprising:

receiving means for receiving and demultiplexing the decodable signal to generate at least an index signal, a coefficient and a phase signal;

code book means for storing a plurality of white noise residual signal vectors and outputting a white noise residual signal vector based on the index signal from said receiving means;

impulse generating means for generating an impulse signal having a predetermined relationship with the white noise residual signal vectors stored in said code book based on the phase signal from said receiving means; and linear prediction means for applying linear prediction to the white noise residual signal vectors and the impulse signal based on the coefficient from the receiving means to reproduce the speech signal.

* * * * *